US007665234B2

(12) United States Patent
Diehl et al.

(10) Patent No.: US 7,665,234 B2
(45) Date of Patent: Feb. 23, 2010

(54) GRADER BLADE WITH TRI-GRADE INSERT ASSEMBLY ON THE LEADING EDGE

(75) Inventors: Timothy J. Diehl, Bedford, PA (US); Don C. Rowlett, Bedford, PA (US); Terry A. Manway, Monroeville, PA (US); Duane E. Carson, Jr., Hollidaysburg, PA (US); Andrew G. Mayer, Sarasota, FL (US); Aniruddha S. Marathe, Bentonville, AR (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 11/901,015

(22) Filed: Sep. 14, 2007

(65) Prior Publication Data

US 2009/0071042 A1 Mar. 19, 2009

(51) Int. Cl.
*E01H 5/06* (2006.01)
*E02F 3/00* (2006.01)

(52) U.S. Cl. ..... 37/266; 37/446; 37/460; 172/701.3; 172/719; 299/122 R

(58) Field of Classification Search ..... 37/266, 37/466, 460; 172/701.1, 747, 701.3, 719; 299/111, 105
See application file for complete search history.

(56) References Cited

U.S. PATENT DOCUMENTS

| | | | | |
|---|---|---|---|---|
| 1,859,350 | A * | 5/1932 | Wilson | 172/713 |
| 1,922,917 | A | 8/1933 | Russell et al. | |
| 1,965,950 | A * | 7/1934 | Walker | 172/713 |
| 3,529,677 | A | 9/1970 | Stephenson | |
| 3,790,353 | A | 2/1974 | Jackson et al. | |
| 3,888,027 | A | 6/1975 | Toews | |
| 3,934,654 | A | 1/1976 | Stephenson et al. | |
| 3,971,323 | A | 7/1976 | Beiswenger | |
| 3,984,910 | A | 10/1976 | Helton et al. | |
| 4,011,051 | A | 3/1977 | Helton et al. | |
| 4,052,802 | A | 10/1977 | Moen et al. | |
| 4,086,966 | A | 5/1978 | Lanz et al. | |
| 4,146,080 | A * | 3/1979 | Baum | 164/97 |
| 4,277,106 | A * | 7/1981 | Sahley | 299/111 |
| 4,339,009 | A * | 7/1982 | Busby | 175/374 |
| 4,359,335 | A | 11/1982 | Garner | |
| 4,498,549 | A * | 2/1985 | Jurgens | 175/430 |
| 4,550,513 | A * | 11/1985 | Rasmussen | 37/448 |

(Continued)

FOREIGN PATENT DOCUMENTS

| | | |
|---|---|---|
| DE | 2 423 963 | 12/1974 |

(Continued)

*Primary Examiner*—Thomas A Beach
(74) *Attorney, Agent, or Firm*—Matthew W. Smith

(57) ABSTRACT

A grader blade includes a grader blade body that has a recess in a bottom edge, and a tri-grade insert assembly is received within the recess. The tri-grade insert assembly includes a leading insert, a mediate insert and a trailing insert. The leading insert has an impact wear resistance and fracture wear resistance greater than the mediate insert and the trailing insert. The trailing insert has an abrasion wear resistance and down-pressure wear resistance greater than the leading insert and the mediate insert. The mediate insert has an impact wear resistance and fracture wear resistance greater than the trailing insert and an abrasion wear resistance and down-pressure wear resistance greater than the leading insert.

17 Claims, 6 Drawing Sheets

U.S. PATENT DOCUMENTS 4,686,080 A * 8/1987 Hara et al. ..... 419/8
4,715,450 A 12/1987 Hallissy et al.
4,770,253 A 9/1988 Hallissy et al.
5,066,546 A * 11/1991 Materkowski ..... 428/627
5,427,186 A * 6/1995 Adrian et al. ..... 172/701.3
5,543,235 A 8/1996 Mirchandani et al.
H1642 H * 4/1997 Jenkins ..... 405/159
5,677,042 A 10/1997 Massa et al.
5,778,572 A 7/1998 Lukavich et al.
5,813,474 A 9/1998 Manway
5,881,480 A 3/1999 Fall
6,003,617 A * 12/1999 McSweeney et al. ..... 172/719
6,571,493 B2 * 6/2003 Amano et al. ..... 37/460
6,685,880 B2 2/2004 Engstrom et al.
6,751,894 B2 * 6/2004 Verseef ..... 37/266
6,854,527 B2 * 2/2005 Manway et al. ..... 172/719

FOREIGN PATENT DOCUMENTS

EP 1 524 368 A1 4/2005
GB 1 467 326 3/1977

* cited by examiner

GRADER BLADE WITH TRI-GRADE INSERT ASSEMBLY ON THE LEADING EDGE

BACKGROUND OF THE INVENTION

The present invention generally relates to a blade for use in conjunction with graders, snow plows and like vehicles wherein the blade travels over the surface of a substrate (e.g., the surface of a roadway) to remove snow and ice as well as other debris and material. More specifically, the present invention concerns a grader blade for use in conjunction with graders, snow plows and like vehicles wherein the blade travels over the surface of a substrate (e.g., the surface of a roadway) to remove snow and ice as well as other debris and material wherein the grader blade incorporates an insert assembly at its bottom leading edge to provide for improved impact and performance properties.

Graders and snow plows are both well known and each carry a relatively long moldboard which extends generally laterally (or across) of the substrate surface being worked by the blade. It is conventional practice to mount a grader blade on the lower edge of such moldboard with the blade, in turn, extending downwardly below the lower edge of the moldboard. The grader blade has a lower leading edge that forms the working surface of the blade. The grader (or snow plow) the moves over the surface of the substrate in a direction generally perpendicular to the length of the moldboard. The grader blade then contacts or impacts any material (e.g., snow and ice and other materials) on the surface of the substrate so as to dislodge and remove the same.

In the past, grader blades have been made of steel. Steel grader blades have the advantage of being relatively inexpensive, but also the disadvantage of wearing out rapidly since the scraping operation can be a very abrasive operation. Once worn out, one must replace the steel blade to avoid damage to the moldboard. Replacement of the steel blade is, of course, time consuming and represents downtime for the equipment. Thus, over the years, various techniques, such as impregnation and hardfacing of the blade cutting edge with carbide particles. For example, cemented carbide inserts can be attached into or onto the blade edge in an attempt to prolong the life of the steel blade. Earlier prior art grader blades includes those shown and described in the following patent documents: U.S. Pat. No. 1,922,917 to Russell et al., U.S. Pat. No. 3,529,677 to Stephenson, U.S. Pat. No. 3,790,353 to Jackson et al.,), U.S. Pat. No. 3,971,323 to Beiswenger, U.S. Pat. No. 3,888,027 to Toews, U.S. Pat. No. 3,934,654 to Stephenson et al.,) and U.S. Pat. No. 4,052,802 to Moen et al. A similar type of blade where a cemented carbide inserts can be attached into or onto the blade edge is a blade identified as a Kengard A grader blade manufactured by Kennametal Inc. of Latrobe, Pa. 15650 United States of America.

In addition to the above described grader blades, U.S. Pat. No. 4,715,450 to Hallissy et al. discloses a grader blade that presents a casting-insert assembly at the bottom leading edge thereof. The following excerpt (Col. 4, lines 4 through 18) from the '450 Hallissy et al. patent describes the blade structure:

> The grader blade 18 includes a casted assembly, generally indicated by numeral 38, being composed of a rear preformed cemented carbide insert 40 and a front casted layer 42 of carbide grit in combination with a substrate 44 of casting material. The substrate 44 holds the insert 40 and layer 42 in a tiered contacting and attached relationship with one another. The casted assembly 38 is disposed in the recess 36 and the substrate 44 is welded to the body 20 such that the casted assembly 38, the insert 40 and layer 42, extend beyond the front and bottom surfaces 30,34 of the body edge 28 for contacting the surface being worked. In actuality, the casted layer 42 of carbide grit is disposed substantially outside of the recess 36 and forwardly of the front surface 30 on the steel body 20.

Further, U.S. Pat. No. 4,770,253 to Hallissy et al. discloses a grader blade. The Abstract from the '253 Hallissy et al. patent describes this grader blade structure:

> A grader blade has a steel body with a bottom edge incorporating a pair of tiered, elongated carbide inserts in a forward portion thereof. The carbide inserts, being arranged in a tiered contacting relationship, are disposed in a stepped recess formed in and along the forward portion of the bottom edge of the blade body and brazed to the blade body and to each other so as to project forwardly and downwardly from the recess. A front one of the tiered inserts is composed of a cemented carbide composition having a high cobalt content, for instance 20 percent by weight, adapting it for enhanced impact wear resistance, whereas a rear one of the tiered inserts is composed of a cemented carbide composition having a low cobalt content, for instance 11.5 percent by weight, adapting it for enhanced downpressure wear resistance.

While many of these grader blades appear to operate reasonably well under the operating conditions for which they were designed, most grader blades seem to embody one or more shortcomings in terms of complexity, performance, reliability and cost effectiveness. In reference to the structure as disclosed in U.S. Pat. No. 4,770,253 to Hallissy et al., the trailing insert has the tendency to fracture prematurely. When this happens, the trailing insert falls off the blade thereby leaving the leading insert to absorb all of the impacts, as well as provide the wear resistance to the grader blade.

There remains a need to provide an improved grade blade structure that exhibits acceptable performance properties. In this regard, it would be desirable to provide an improved grader blade that more adequately addresses the kinds of wear and forces encountered by the bottom leading edge of the grader blade.

It would also be desirable to provide an improved grader blade that provides improved impact wear resistance. It would also be desirable to provide an improved grader blade that provides improved fracture wear resistance. It would also be desirable to provide an improved grader blade that provides improved abrasion wear resistance. It would also be desirable to provide an improved grader blade that provides improved down-pressure wear resistance.

SUMMARY OF THE INVENTION

In one form thereof, the invention is a grader blade that comprises a grader blade body that has a recess contained in a bottom edge and a tri-grade insert assembly received within the recess. The tri-grade insert assembly comprises a leading insert, a mediate insert and a trailing insert. The leading insert has an impact wear resistance and fracture wear resistance greater than the mediate insert and the trailing insert. The trailing insert has an abrasion wear resistance and down-pressure wear resistance greater than the leading insert and the mediate insert. The mediate insert has an impact wear resistance and fracture wear resistance greater than the trailing insert and an abrasion wear resistance and down-pressure wear resistance greater than the leading insert.

In another form thereof, the invention is a grader blade-moldboard assembly that comprises a moldboard and a grader blade body secured to the moldboard. The grader blade body has a recess contained in a bottom edge. A tri-grade insert assembly is received within the recess. The tri-grade insert assembly comprises a leading insert, a mediate insert and a trailing insert. The leading insert has an impact wear resistance and fracture wear resistance greater than the mediate insert and the trailing insert. The trailing insert has an abrasion wear resistance and down-pressure wear resistance greater than the leading insert and the mediate insert. The mediate insert has an impact wear resistance and fracture wear resistance greater than the trailing insert and an abrasion wear resistance and down-pressure wear resistance greater than the leading insert.

In yet another form thereof, the invention is a grader blade that comprises a grader blade body that has a recess contained in a bottom edge and an insert assembly received within the recess. The insert assembly comprises a leading insert, a mediate insert and a trailing insert. The leading insert comprises one of the following materials: cemented carbides, ceramics, cermets, chromium-carbide-coated metals, cermets where titanium carbide or vanadium carbide is added to tungsten carbide, aluminum-based ceramics, silicon-based ceramics, zirconium-based ceramics, glass-based ceramics, and superhard materials. The leading insert has an impact wear resistance and fracture wear resistance greater than the trailing insert. The trailing insert comprises one of the following materials: cemented carbides, ceramics, cermets, chromium-carbide-coated metals, cermets where titanium carbide or vanadium carbide is added to tungsten carbide, aluminum-based ceramics, silicon-based ceramics, zirconium-based ceramics, glass-based ceramics, and superhard materials. The trailing insert has an abrasion wear resistance and down-pressure wear resistance greater than the leading insert. The mediate insert comprises one of the following materials: urethane materials, polyurethane materials, rubber materials and plastic materials.

In still another form thereof, the invention is a grader blade that comprises a grader blade body that has a recess contained in a bottom edge and a tri-grade insert assembly received within the recess. The tri-grade insert assembly comprises a leading region, a mediate region and a trailing region. The leading region has an impact wear resistance and fracture wear resistance greater than the mediate region and the trailing region. The trailing region has an abrasion wear resistance and down-pressure wear resistance greater than the leading region and the mediate region. The mediate region has an impact wear resistance and fracture wear resistance greater than the trailing region and an abrasion wear resistance and down-pressure wear resistance greater than the leading region.

BRIEF DESCRIPTION OF THE DRAWINGS

The following is a brief description of the drawings that form a part of this patent application.

DETAILED DESCRIPTION

Figure 1:
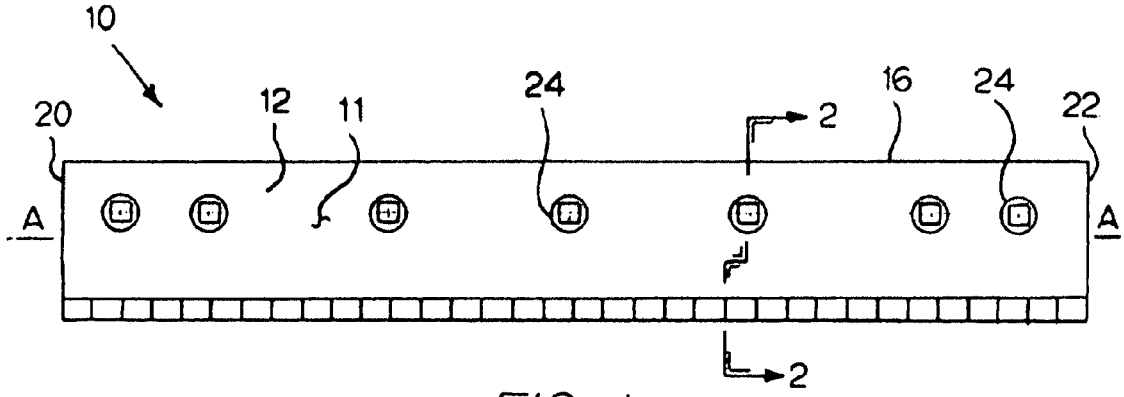
FIG. 1 is a front view of one specific embodiment of the grader blade secured to the lower edge of the moldboard, but with the moldboard removed from the drawing.
Figure 2:
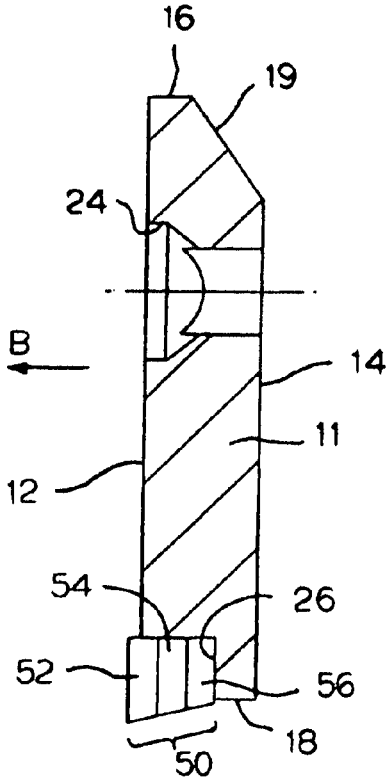
FIG. 2 is a sectional view of the grader blade taken along section line 2-2 of FIG. 1 with the bolt removed and the tri-grade insert assembly not shown in cross-section.

Referring the description set forth below, like reference characters designate like or corresponding parts throughout the several views. Furthermore, in the following description, one should understand that terms as "forward", "rearward", "left", "right", "upwardly", "downwardly", and the like, are words of convenience, and one should not construe these and like terms as limiting terms.

Referring now to the drawings, there is a grader blade generally designated as 10. Grader blade 10 has a body 11 with a longitudinal axis A-A. Grader blade body 11 has a leading or forward face 12, a trailing or rear face 14, a top surface 16 and a bottom surface 18. An inclined or beveled surface 19 joins the top surface 16 and the trailing surface 14 of the grade blade body 11. Grader blade 10 also presents opposite side surfaces 20, 22. Grader blade 10 further contains a plurality of spaced apart holes 24 that receive bolts to attach the grader blade 10 to the moldboard as will become apparent from the description below. There should be an appreciation that, in addition to mechanical fastening, the grade blade 10 can be affixed or attached to the moldboard by any one a variety of methods including, without limitation, welding.

Figure 4:
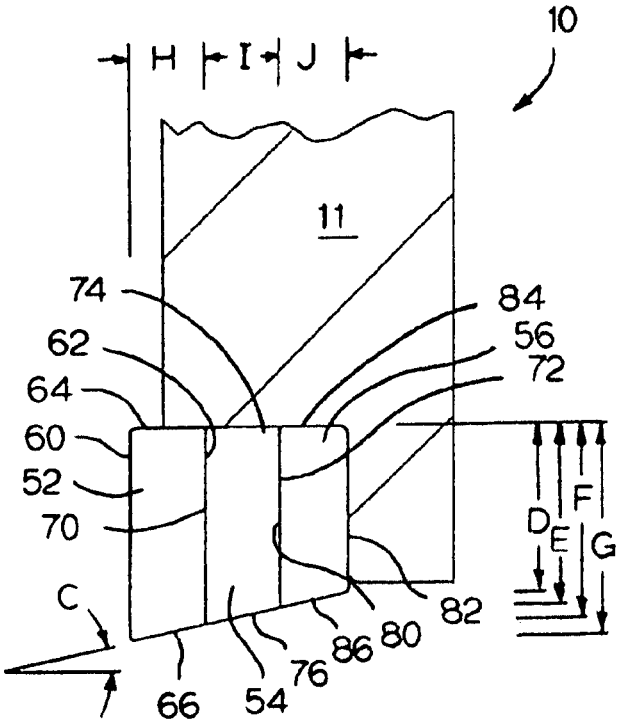
FIG. 4 is an enlarged cross-sectional view of the lower portion of the grader blade of FIG. 2 with the tri-grade insert assembly not shown in cross-section.
Figure 4A:
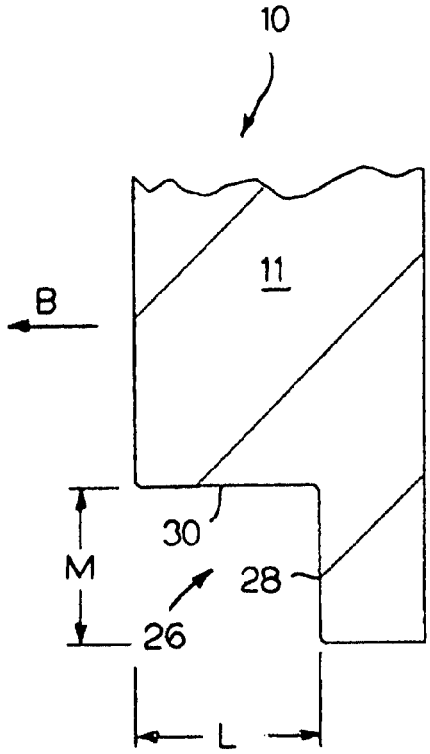
FIG. 4A is an enlarged cross-sectional view of the lower portion of the grader blade of FIG. 2 with the tri-grade insert assembly removed showing the recess.
Figure 5:
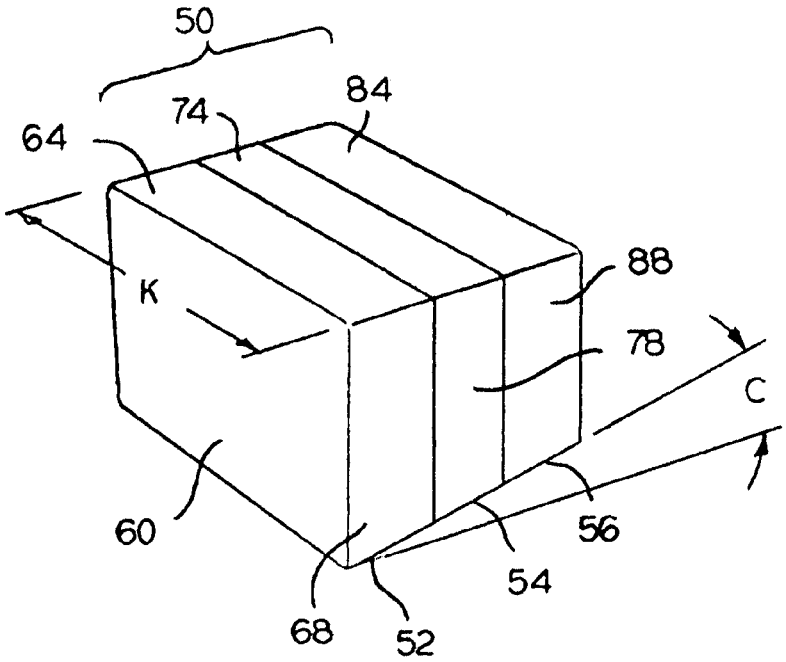
FIG. 5 is an isometric view of the tri-grade insert assembly of FIG. 1.

Grader blade 10 also contains a recess 26 that extends across the bottom edge of the leading face 12 of the grader blade 10. Recess 26 has a generally vertical surface 28 (as viewed in FIG. 4A), which is generally perpendicular to the direction of movement (see arrow B) of the grader blade 10 when in operation. Generally vertical surface 28 a width equal to M. Notch 26 has a generally horizontal surface 30 (as viewed in FIG. 4A), which is generally parallel to the direction of movement (see arrow B) of the grader blade 10 when in operation. Generally horizontal surface 30 has a width equal to L.

Grader blade 10 comprises a ferrous material such as a steel alloy. Exemplary steel alloys comprise the following: carbon steels including without limitation 1020-1045 AISI grades of steel, alloys steels, and boron steels. Other materials for the grader blade 10 include without limitation the following materials: cast ferrous materials and wrought ferrous materials. In other instances, suitable materials for the grader blade body include urethane materials, polyurethane materials, rubber materials and plastic materials. There should be an appreciation that the use of such a more resilient material for the grader blade body can cause the inserts to exhibit a squeegee affect when impinging upon the snow and ice, as well as other debris and material on the roadway. The benefits of such a squeegee affect are described in more detail hereinafter.

Grader blade 10 includes a tri-grade insert assembly shown by bracket 50. Tri-grade insert assembly 50 comprises a leading insert 52, a mediate insert 54 and a trailing insert 56. In this specific embodiment, each of the inserts presents a generally trapezoidal geometry; however, one should appreciate that other geometries may be suitable for use in the grader blade. Each one of these inserts (52, 54, 56) is made from a different material. The difference may be in composition (e.g., cemented (cobalt) tungsten carbide with different cobalt contents for the different inserts). The difference may be in kind (e.g., a cemented (cobalt) tungsten carbide insert and a ceramic insert). There should be an appreciation that inserts could be steel made via powder metallurgical techniques. In this regard, an assembly of the three inserts could comprise a cemented carbide insert, a steel insert and a ceramic insert. The orientation of the inserts would depend upon the specific application.

The specific embodiments illustrate inserts that have a particular size and geometry. There should be an understanding that the inserts can be of many different heights, widths, and other geometric features (e.g., the extent the insert extends past the bottom surface of the grader blade body). By varying the geometry and size of the inserts, one can accommodate a variety of working environments.

A typical composition for the inserts is cemented (cobalt) tungsten carbide where the cobalt content can vary between the leading insert, the mediate insert and the trailing insert. For example, the leading insert 52 can comprise a composition of about 20 weight percent cobalt and the balance tungsten carbide with recognized impurities. This kind of cobalt-tungsten carbide material (i.e., 20 weight percent cobalt) possesses enhanced impact wear resistance properties and fracture wear resistance properties. One should appreciate that the composition of the leading insert can also range between about 18 weight percent and about 22 weight percent cobalt with the balance tungsten carbide and recognized impurities. As an alternative, the composition of the leading insert can also range between about 19.5 weight percent and about 20.5 weight percent cobalt with the balance tungsten carbide and recognized impurities.

The mediate insert 54 can comprise a composition of between about 14 weight percent and about 16 weight percent cobalt and the balance tungsten carbide with recognized impurities. This kind of cobalt-tungsten carbide material (i.e., 14-16 weight percent cobalt) possesses high to moderate impact wear resistance properties and fracture wear resistance properties.

The trailing insert can comprise a composition of between about 11 weight percent and about 13 weight percent cobalt and the balance tungsten carbide with recognized impurities. This kind of cobalt-tungsten carbide material (i.e., 11-13 weight percent cobalt) possesses high abrasion wear resistance properties and down-pressure wear resistance properties. One should appreciate that the composition of the trailing insert can also range between about 11 weight percent and about 12.4 weight percent cobalt with the balance tungsten carbide and recognized impurities.

Other materials are suitable for use as inserts. These materials include without limitation ceramics and cermets including without limitation the following: chromium-carbide-coated metals, cermets where titanium carbide or vanadium carbide is added to tungsten carbide, aluminum-based ceramics, silicon-based ceramics, zirconium-based ceramics, glass-based ceramics, and superhard materials such as for example cubic boron nitride. It is contemplated that materials such as, for example, rubber or polyurethane or urethane may be suitable for use as insert material (or material for spacer between the inserts), especially for use to help cushion the harder inserts from impacts.

Figure 9:
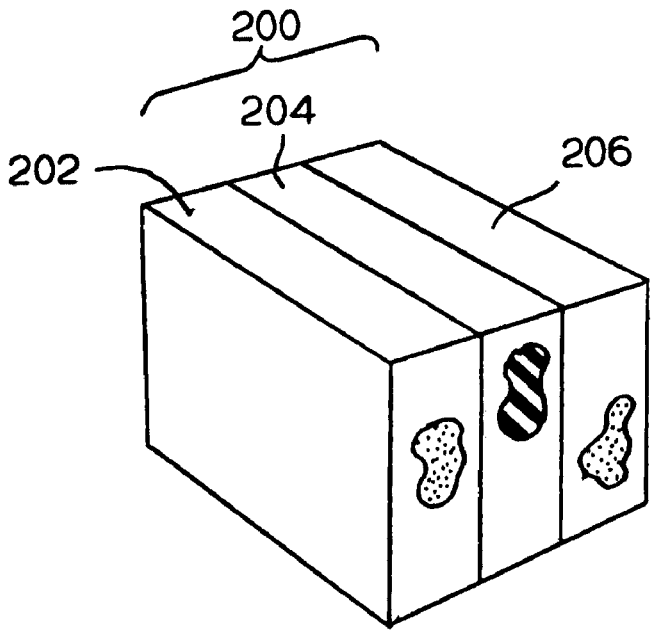
FIG. 9 is an isometric view of a fifth specific embodiment of an insert assembly that has a leading insert, a trailing insert and a mediate insert wherein the mediate insert comprises a resilient material.
Figure 10:
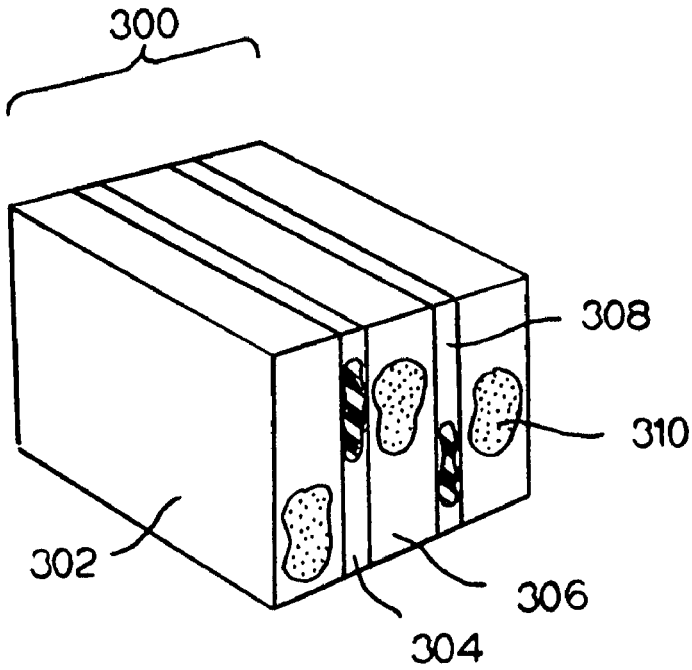
FIG. 10 is an isometric view of a sixth specific embodiment of an insert assembly that has a leading insert, a trailing insert and a mediate insert wherein one resilient spacer is between the mediate insert and the leading insert and another resilient spacer is between the mediate insert and the trailing insert.

Further, there should be the appreciation that the use of the rubber or polyurethane as insert material can reduce the road vibration for the grader blade. There should be an appreciation that the use of the rubber or polyurethane as insert material can cause the inserts to exhibit a squeegee affect when impinging upon the snow and ice, as well as other debris and material on the roadway. The apparent cause of the squeegee affect is the resiliency (or flexure) provided to the entire insert assembly by the use of the resilient member. This resiliency or flexure feature is especially beneficial in the removal of ice and snow, as well as other debris, from the surface of an airport runway. As one can appreciate, a very clean (or relatively clean) runway surface is beneficial to the normal use of the runway by aircraft in landing, taking off and taxing. FIGS. 9 and 10 illustrate two specific embodiments that use more resilient components to provide a squeegee affect.

In reference to the properties of the inserts relative to one another, notwithstanding the materials that comprise the inserts, the leading insert typically exhibits the best impact wear resistance and fracture wear resistance. This is necessary because the leading insert typically first encounters or impacts the snow, ice or other materials on the surface of the substrate. Consequently, the leading insert suffers the greatest extent of impacts, and thus, it is made of a material that exhibits the best impact wear resistance and fracture wear resistance.

The trailing insert typically exhibits the best abrasion wear resistance and down-pressure wear resistance. This is necessary because the trailing insert experiences the greatest degree of the abrasion type contact with the surface of the substrate. In addition, the down-pressure exerted on the grader blade is transferred to the trailing insert, at to the greatest degree. Consequently, the trailing insert suffers the greatest extent of abrasive wear, and thus, it is made from a material that exhibits the best abrasion wear resistance and down-pressure wear resistance.

The mediate insert typically does not experience the greatest extent of impacts or the greatest degree of abrasion type contact with the surface of the substrate or transfer of the down-pressure in the blade, but instead, experiences these conditions that result in wear in a moderate level. In other words, the mediate insert experiences impacts less than the leading insert, but more than the trailing insert. This means that the mediate insert should have impact wear resistance properties and fracture wear resistance properties that are better than the trailing insert but less than the leading insert. Also, the mediate insert experience abrasion type contact with the surface of the substrate and a transfer of the down-pressure to a lesser degree than the trailing insert but to a greater degree than the leading insert. This means that the mediate insert should have abrasion wear resistance and down-pressure wear resistance properties better than the trailing insert but greater than the leading insert.

Referring to the geometry of the inserts, each insert presents a generally trapezoidal shape. Leading insert 52 has a leading or forward surface (or face) 60, a trailing surface 62, a top surface 64, a bottom surface 66 and a side surface 68. The bottom surface 66 is disposed with respect to the top surface 64 at an angle B. Mediate insert 54 has a leading or forward surface (or face) 70, a trailing surface 72, a top surface 74, a bottom surface 76 and a side surface 78. The bottom surface 76 is disposed with respect to the top surface 74 at an angle B. Trailing insert 56 has a leading or forward surface (or face) 80, a trailing surface 82, a top surface 84, a bottom surface 86 and a side surface 88. The bottom surface 86 is disposed with respect to the top surface 84 at an angle B.

The leading insert 52 has a thickness H and a width K. The height at the leading surface 60 is G and the height at the trailing surface 62 is F. The mediate insert 54 has a thickness I and a width K. The height at the leading surface 70 is F and the height at the trailing surface 72 is E. The trailing insert 56 has a thickness J and a width K. The height at the leading surface 80 is E and the height at the trailing surface 82 is D. Table I sets forth the specific dimensions for a specific embodiment; however, there should be an appreciation that the specific dimensions and relationships between the dimensions can vary to suit specific applications.

TABLE I

Specific Dimensions for a Specific Embodiment

| Dimension | Magnitude |
|---|---|
| C | 14 Degrees |
| D | 1.35128 Centimeters |
| E | 1.4478 Centimeters |
| F | 1.5875 Centimeters |
| G | 1.7272 Centimeters |
| H | 0.5588 Centimeters |
| I | 0.5588 Centimeters |
| J | 0.5588 Centimeters |
| K | 2.54 Centimeters |
| L | 1.397 Centimeters |
| M | 1.3081 Centimeters |

The inserts (52, 54, 56) are attached to each other in the following manner through the use of braze alloys or epoxy glues. The type of braze alloy or epoxy glue depends upon the specific application and the compositions of the insert. While the leading surface 60 of the leading insert 52 is not directly contacting another insert, the trailing surface 62 of leading insert 52 directly contacts and joins to the leading surface 64 of the mediate insert 54. The trailing surface 70 of the mediate insert 54 directly contacts and joins to the leading surface 80 of the trailing insert 56. Due to the extra braze joints, there should be an appreciation that the assembly of the three inserts exhibits a greater degree of toughness/impact resistance in comparison to the assembly comprising only two insert.

While the trailing surface 82 of the trailing insert 54 does not directly contact another insert, it directly contacts the generally vertical wall 28 of the recess 26 and helps facilitate the attachment of the tri-grade insert assembly 50 to the recess 26. The top surfaces (64, 74, 84) of the inserts (52, 54, 56), respectively, directly contact the generally horizontal surface 30 of the recess 26 and help facilitate the attachment of the tri-grade insert assembly 50 within the recess 26. The bottom surfaces (66, 76, 86) of the inserts (52, 54, 56) together form a bottom surface for the tri-grade insert assembly 50 that has a disposition with respect to the top surfaces equal to angle C.

Figure 3:
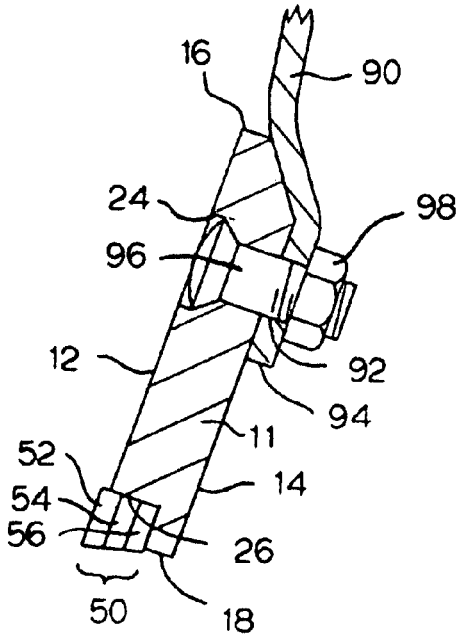
FIG. 3 is a sectional view of the grader blade along the lines of FIG. 2, but with the grader blade attached to the moldboard (in cross-section) via a bolt-nut assembly.

FIG. 3 shows the connection between the moldboard 90 and the grader blade 10. The bottom end 94 of the moldboard 90 contains an aperture 92 therein. To attach the grader blade 10 to the moldboard 90, the holes 24 in the grader blade 10 are aligned with the apertures 92 in the moldboard 90. Bolts 96 are passes through both the holes 24 and apertures 92 and each bolt 96 is secured with a nut 98 that securely connects the grader blade 10 to the moldboard 90 when fully tightened. One should appreciate that an upper end portion of the grader blade 10 presents a shape (defined by the inclined surface 19) that corresponds to the combined contour of the inclined portion and terminal portion of the moldboard 90 so as to facilitate rigid attachment of the grader blade to the moldboard by bolts.

Figure 6:
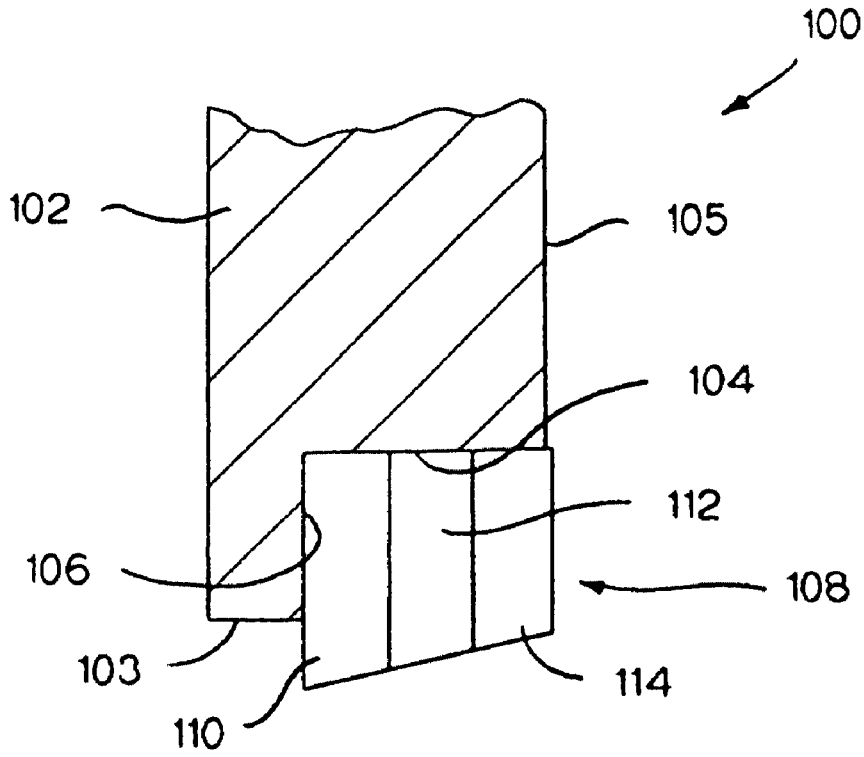
FIG. 6 is an enlarged cross-sectional view of the lower portion of a second specific embodiment of a grader blade wherein the recess opens to the trailing surface of the grader blade.

FIG. 6 illustrates a second specific embodiment of the grader blade generally designated as 100. Grader blade 100 has a grader blade body 102, which has a bottom end 103. The grader blade body 102 contains a recess that opens to the trailing surface 105 of the grader blade body 102. The recess has a horizontal surface 104 (as viewed in FIG. 6) and a vertical surface 106 (as viewed in FIG. 6). The grader blade 100 carries a tri-grade insert assembly generally designated as 108 in the recess thereof. The tri-grade insert assembly 108 includes a leading insert 110, a mediate insert 112, and a trailing insert 114. The tri-grade insert assembly 108 is affixed into the recess by methods such as those described earlier herein.

The compositional considerations that exist for the inserts of the tri-insert assembly of the first specific embodiment of the grader blade assembly, exist for this second specific embodiment of the grader blade assembly. In this regard, the leading insert typically exhibits the best impact wear resistance and fracture wear resistance. This is necessary because the leading insert typically first encounters or impacts the snow, ice or other materials on the surface of the substrate and suffers the greatest extent of impacts. The trailing insert typically exhibits the best abrasion wear resistance and down-pressure wear resistance because the trailing insert experiences the greatest degree of the abrasion type contact with the surface of the substrate due in part to the down-pressure transferred to the trailing insert. The mediate insert typically does not experience the greatest extent of impacts or the greatest degree of abrasion type contact with the surface of the substrate or transfer of the down-pressure in the blade, but instead, experiences those conditions that result in wear in a moderate level. The mediate insert should possess impact wear resistance properties and fracture wear resistance properties that are better than the trailing insert but less than the leading insert. The mediate insert experiences abrasion type contact with the surface of the substrate and a transfer of the down-pressure to a lesser degree than the trailing insert but to a greater degree than the leading insert. The mediate insert should possess abrasion wear resistance and down-pressure wear resistance properties better than the trailing insert but greater than the leading insert.

Figure 7:
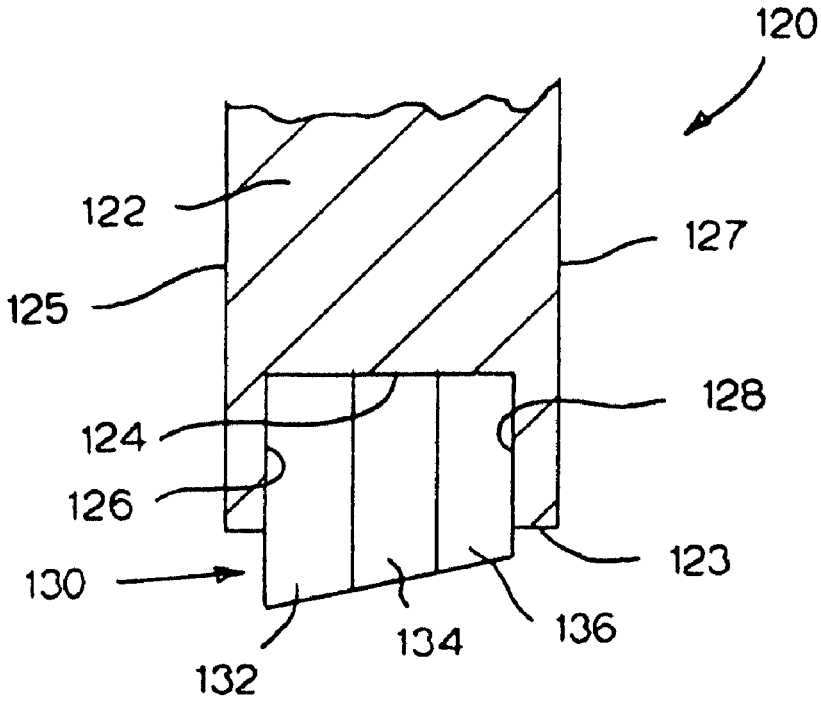
FIG. 7 is an enlarged cross-sectional view of the lower portion of a third specific embodiment of a grader blade wherein the recess is mediate of the leading surface and the trailing surface of the grader blade.

FIG. 7 illustrates a third specific embodiment of the grader blade generally designated as 120. Grader blade 120 has a grader blade body 122. The grader blade body 122 has a bottom end 123, as well as a leading surface 125 and a trailing surface 127. The grader blade body 120 contains a recess that opens at the bottom surface mediate of the leading surface 125 and the trailing surface 127. The recess has a horizontal surface 124 (as viewed in FIG. 7), a leading vertical surface 126 (as viewed in FIG. 76), and a trailing vertical surface 128 (as viewed in FIG. 7). The grader blade 120 carries a tri-grade insert assembly generally designated as 130 in the recess thereof. The tri-grade insert assembly 130 includes a leading insert 132, a mediate insert 134, and a trailing insert 136. The tri-grade insert assembly 108 is affixed into the recess by methods such as those described earlier herein.

The compositional considerations that exist for the inserts of the tri-insert assembly of the first specific embodiment of the grader blade assembly, exist for this third specific embodiment of the grader blade assembly. In this regard, the leading insert typically exhibits the best impact wear resistance and fracture wear resistance. This is necessary because the leading insert typically first encounters or impacts the snow, ice or other materials on the surface of the substrate and suffers the greatest extent of impacts. The trailing insert typically exhibits the best abrasion wear resistance and down-pressure wear resistance because the trailing insert experiences the greatest degree of the abrasion type contact with the surface of the substrate due in part to the down-pressure transferred to the trailing insert. The mediate insert typically does not experience the greatest extent of impacts or the greatest degree of abrasion type contact with the surface of the substrate or transfer of the down-pressure in the blade, but instead, experiences those conditions that result in wear in a moderate level. The mediate insert should possess impact wear resistance properties and fracture wear resistance properties that are better than the trailing insert but less than the leading insert. The mediate insert experiences abrasion type contact with the surface of the substrate and a transfer of the down-pressure to a lesser degree than the trailing insert but to a greater degree than the leading insert. The mediate insert should possess abrasion wear resistance and down-pressure wear resistance properties better than the trailing insert but greater than the leading insert.

Figure 8:
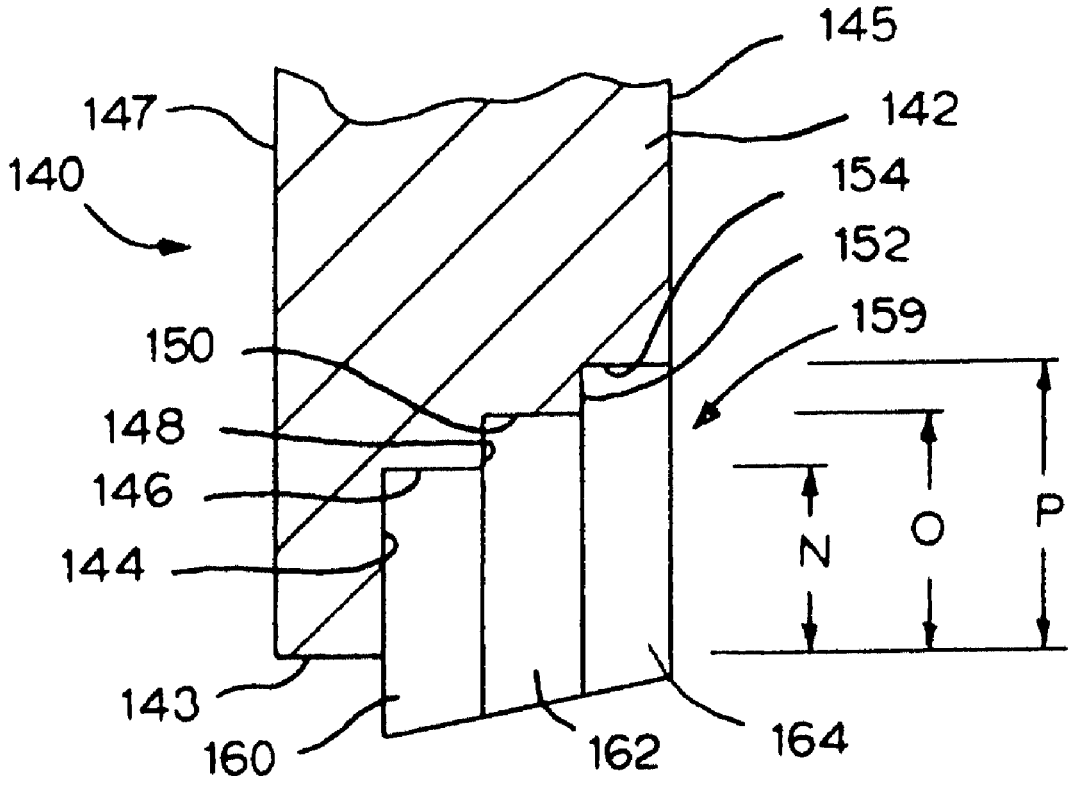
FIG. 8 is an enlarged cross-sectional view of the lower portion of a fourth specific embodiment of a grader blade wherein the recess, which presents steps, opens to the trailing surface of the grader blade.

FIG. 8 illustrates a fourth specific embodiment of the grader blade generally designated as 140. Grader blade 140 has a grader blade body 142. The grader blade body 142 has a bottom end 143, as well as a leading surface 147 and a trailing surface 145. The grader blade body 142 contains a stepped recess that opens at the bottom surface as well as to the trailing surface 145.

In regard to the stepped recess, the stepped recess comprises a leading vertical surface 144 and leading horizontal surface 146 (as viewed in FIG. 8). The leading vertical surface 144 and leading horizontal surface 146 defines the leading step. The leading step extends from the bottom edge 143 a distance (or has a depth) equal to dimension "N". The stepped recess comprises a mediate vertical surface 148 and a mediate horizontal surface 150 (as viewed in FIG. 8). The mediate vertical surface 148 and the mediate horizontal surface 150 defines the mediate step. The mediate step extends from the bottom edge 143 a distance (or has a depth) equal to dimension "O". There should be an appreciation of the fact that dimension "N" is less than "dimension "O". The stepped recess comprises a trailing vertical surface 152 and trailing horizontal surface 154 (as viewed in FIG. 8). The trailing vertical surface 152 and trailing horizontal surface 154 defines the trailing step. The trailing step extends from the bottom edge 143 a distance (or has a depth) equal to dimension "P". There should be an appreciation of the fact that dimension "N" is less than "dimension "P", and that dimension "O" is less than dimension "P".

The grader blade 140 carries a tri-grade insert assembly generally designated as 159 in the recess thereof. The tri-grade insert assembly 159 includes a leading insert 160 that is contained within the leading step, a mediate insert 162 that is contained within the mediate step, and a trailing insert 164 that is contained within the trailing step. The tri-grade insert assembly 159 is affixed into the recess by methods such as those described earlier herein.

The compositional considerations that exist for the inserts of the tri-insert assembly of the first specific embodiment of the grader blade assembly, exist for this fourth specific embodiment of the grader blade assembly. In this regard, the leading insert typically exhibits the best impact wear resistance and fracture wear resistance. This is necessary because the leading insert typically first encounters or impacts the snow, ice or other materials on the surface of the substrate and suffers the greatest extent of impacts. The trailing insert typically exhibits the best abrasion wear resistance and down-pressure wear resistance because the trailing insert experiences the greatest degree of the abrasion type contact with the surface of the substrate due in part to the down-pressure transferred to the trailing insert. The mediate insert typically does not experience the greatest extent of impacts or the greatest degree of abrasion type contact with the surface of the substrate or transfer of the down-pressure in the blade, but instead, experiences those conditions that result in wear in a moderate level. The mediate insert should possess impact wear resistance properties and fracture wear resistance properties that are better than the trailing insert but less than the leading insert. The mediate insert experiences abrasion type contact with the surface of the substrate and a transfer of the down-pressure to a lesser degree than the trailing insert but to a greater degree than the leading insert. The mediate insert should possess abrasion wear resistance and down-pressure wear resistance properties better than the trailing insert but greater than the leading insert.

FIG. 9 illustrates a fifth specific embodiment of the insert assembly shown by bracket 200. Insert assembly 200 comprises a leading insert 202 wherein insert 202 is made form on of the following materials: cemented carbides, ceramics, cermets, chromium-carbide-coated metals, cermets where titanium carbide or vanadium carbide is added to tungsten carbide, aluminum-based ceramics, silicon-based ceramics, zirconium-based ceramics, glass-based ceramics, and superhard materials. Insert assembly 200 further comprises a trailing insert 206. Trailing insert 206 comprises one of the following materials: cemented carbides, ceramics, cermets, chromium-carbide-coated metals, cermets where titanium carbide or vanadium carbide is added to tungsten carbide, aluminum-based ceramics, silicon-based ceramics, zirconium-based ceramics, glass-based ceramics, and superhard materials. The leading insert has an impact wear resistance and fracture wear resistance greater than the trailing insert. The trailing insert has an abrasion wear resistance and down-pressure wear resistance greater than the leading insert. The insert assembly 200 includes a mediate insert 204. Mediate insert 204 comprises one of the following materials: urethane materials, polyurethane materials, rubber materials and plastic materials.

FIG. 10 illustrates a sixth specific embodiment of the insert assembly shown by bracket 300. Insert assembly 300 comprises a leading insert 302, a mediate insert 306 and a trailing insert 310. Each one of the leading insert 302, mediate insert 306 or trailing insert 310 is made form on of the following materials: cemented carbides, ceramics, cermets, chromium-carbide-coated metals, cermets where titanium carbide or vanadium carbide is added to tungsten carbide, aluminum-based ceramics, silicon-based ceramics, zirconium-based ceramics, glass-based ceramics, and superhard materials. The leading insert has an impact wear resistance and fracture wear resistance greater than the mediate insert and the trailing insert. The trailing insert has an abrasion wear resistance and down-pressure wear resistance greater than the leading insert and the mediate insert. The mediate insert has an impact wear resistance and fracture wear resistance greater than the trailing insert and an abrasion wear resistance and down-pressure wear resistance greater than the leading insert.

The insert assembly 300 includes one spacer 304 between the leading insert 302 and the mediate insert 306, and another spacer 308 between the mediate insert 306 and the trailing insert 310. Each one of the spacers is made from one of the following materials: urethane materials, polyurethane materials, rubber materials and plastic materials.

In each one of the insert assemblies of FIG. 9 and FIG. 10, the use of the rubber or polyurethane or urethane material as an insert or spacer can reduce the road vibration for the grader blade. There should be an appreciation that the use of such a more resilient material for the insert or the spacer can cause the inserts to exhibit a squeegee affect when impinging upon the snow and ice, as well as other debris and material on the roadway. The apparent cause of the squeegee affect is the resiliency (or flexure) provided to the entire insert assembly by the use of the resilient member. This resiliency or flexure feature is especially beneficial in the removal of ice and snow, as well as other debris, from the surface of an airport runway. As one can appreciate, a very clean (or relatively clean) runway surface is beneficial to the normal use of the runway by aircraft in landing, taking off and taxing.

Figure 11:
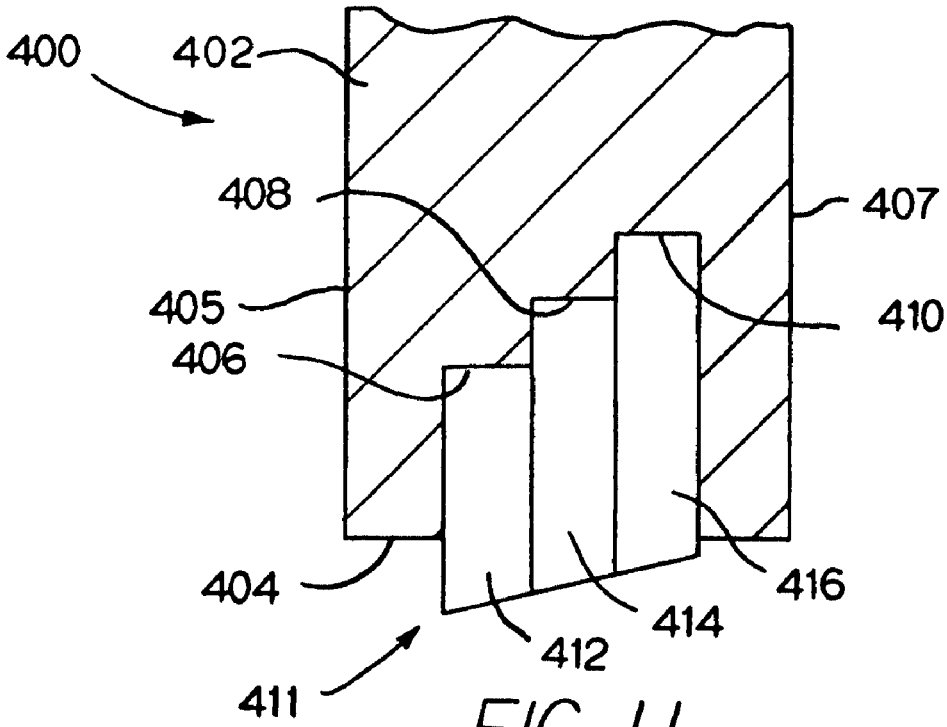
FIG. 11 is an enlarged cross-sectional view of the lower portion of a fifth specific embodiment of a grader blade wherein the recess, which is mediate of the leading surface and the trailing surface, presents steps that become deeper in the direction from the leading surface to the trailing surface.

Referring to FIG. 11, there is illustrated a fifth specific embodiment of a grader blade assembly generally designated as 400. Grader blade assembly 400 has a grader blade body 402 that has a bottom end 404, a leading surface 405, and a trailing surface 407. The grader blade body 402 contains a stepped recess that is mediate between the leading surface 405 and the trailing surface 407. The depth of each step becomes greater, i.e., the steps become deeper, in the direction of moving from the leading surface 405 to the trailing surface 407. In other words, and the leading step, mediate step and trailing step become deeper in the direction of the trailing surface. The leading step 406 is closest to the leading surface 405 and has the least depth. The trailing step 410 is closest to the trailing surface 407 and has the greatest depth. The mediate step 408 is mediate of the leading step 406 and the trailing step 410 and has a depth that is between the depth of the leading and trailing steps.

The grader blade 400 carries a tri-grade insert assembly generally designated as 411. The tri-grade insert assembly 411 comprises a leading insert 412 contained within the leading step 406, a mediate insert 414 contained within the mediate step 408 and a trailing insert 416 contained within the trailing step 410. The tri-grade insert assembly is affixed within the recess by methods such as those described earlier herein.

The compositional considerations that exist for the inserts of the tri-insert assembly of the first specific embodiment of the grader blade assembly, exist for this fifth specific embodiment of the grader blade assembly. In this regard, the leading insert typically exhibits the best impact wear resistance and fracture wear resistance. This is necessary because the leading insert typically first encounters or impacts the snow, ice or other materials on the surface of the substrate and suffers the greatest extent of impacts. The trailing insert typically exhibits the best abrasion wear resistance and down-pressure wear resistance because the trailing insert experiences the greatest degree of the abrasion type contact with the surface of the substrate due in part to the down-pressure transferred to the trailing insert. The mediate insert typically does not experience the greatest extent of impacts or the greatest degree of abrasion type contact with the surface of the substrate or transfer of the down-pressure in the blade, but instead, experiences those conditions that result in wear in a moderate level. The mediate insert should possess impact wear resistance properties and fracture wear resistance properties that are better than the trailing insert but less than the leading insert. The mediate insert experiences abrasion type contact with the surface of the substrate and a transfer of the down-pressure to a lesser degree than the trailing insert but to a greater degree than the leading insert. The mediate insert should possess abrasion wear resistance and down-pressure wear resistance properties better than the trailing insert but greater than the leading insert.

Figure 12:
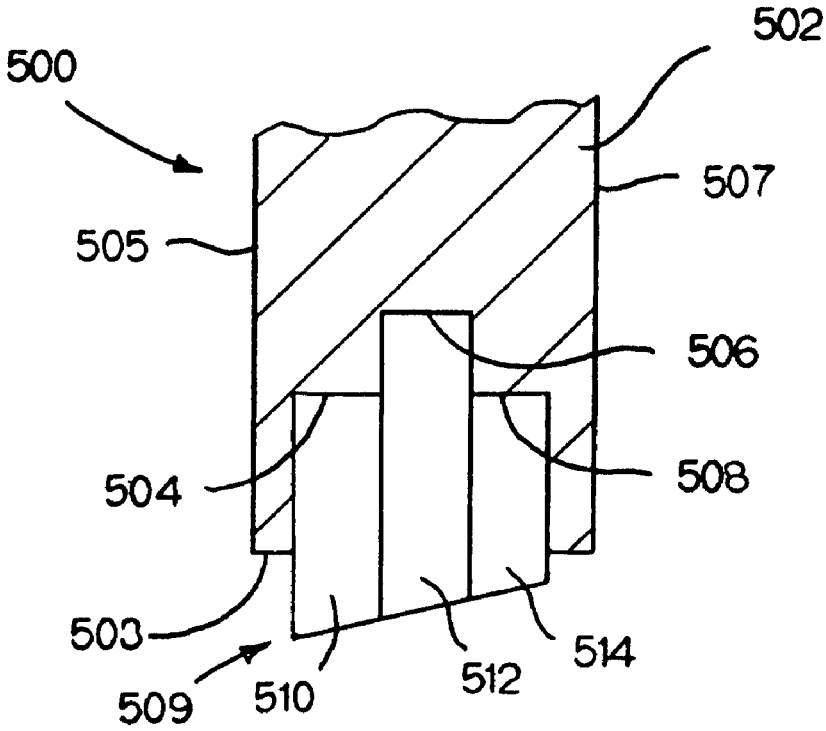
FIG. 12 is an enlarged cross-sectional view of the lower portion of a sixth specific embodiment of a grader blade wherein the recess, which is mediate of the leading surface and the trailing surface, presents mediate step that is deeper than the leading step and the trailing step.

Referring to FIG. 12, there is illustrated a sixth specific embodiment of a grader blade assembly generally designated as 500. Grader blade assembly 500 has a grader blade body 502 that has a bottom end 503, a leading surface 505, and a trailing surface 507. The grader blade body 502 contains a recess that is mediate between the leading surface 505 and the trailing surface 507. The recess has a leading step 504, which is closest to the leading surface 405, and a trailing step 410, which is closest to the trailing surface 407. The leading step 504 and the trailing step 508 are of the same depth. The recess further contains a mediate step 506 that is mediate of the leading step 504 and the trailing step 508. The mediate step 506 has a depth that is greater than the depth of the leading step, as well as the depth of the trailing step.

The grader blade 500 carries a tri-grade insert assembly generally designated as 509. The tri-grade insert assembly 509 comprises a leading insert 510 contained within the leading step 504, a mediate insert 512 contained within the mediate step 506 and a trailing insert 514 contained within the trailing step 508. The tri-grade insert assembly is affixed within the recess by methods such as those described earlier herein.

The compositional considerations that exist for the inserts of the tri-insert assembly of the first specific embodiment of the grader blade assembly, exist for this sixth specific embodiment of the grader blade assembly. In this regard, the leading insert typically exhibits the best impact wear resistance and fracture wear resistance. This is necessary because the leading insert typically first encounters or impacts the snow, ice or other materials on the surface of the substrate and suffers the greatest extent of impacts. The trailing insert typically exhibits the best abrasion wear resistance and down-pressure wear resistance because the trailing insert experiences the greatest degree of the abrasion type contact with the surface of the substrate due in part to the down-pressure transferred to the trailing insert. The mediate insert typically does not experience the greatest extent of impacts or the greatest degree of abrasion type contact with the surface of the substrate or transfer of the down-pressure in the blade, but instead, experiences those conditions that result in wear in a moderate level. The mediate insert should possess impact wear resistance properties and fracture wear resistance properties that are better than the trailing insert but less than the leading insert. The mediate insert experiences abrasion type contact with the surface of the substrate and a transfer of the down-pressure to a lesser degree than the trailing insert but to a greater degree than the leading insert. The mediate insert should possess abrasion wear resistance and down-pressure wear resistance properties better than the trailing insert but greater than the leading insert.

In all of the embodiments, the inserts of the tri-grade insert assemblies are shown as separate members. While this is the case with the specific embodiments, there should be an appreciation that the insert assembly could take on the form of a single member. In the case where the tri-grade insert assembly is a single member, the single member would have regions that correspond to the leading, mediate and trailing inserts of the tri-grade insert assembly. In other words, even though the insert would be a single member, it would have three regions so to be a tri-region insert. There should also be an appreciation that the insert assembly could comprise one dual grade member and a single grade member. In such an embodiment, the insert assembly would still present a tri-grade feature, but embodied in two members. The dual grade member could correspond to any two of the leading, mediate and trailing inserts with the single member corresponding to the remaining insert. The tri-grade single member and the dual grade member-single member assembly can be made via powder metallurgical techniques.

In operation, the leading insert of the grader blade impacts against the snow, ice and other debris under the driving force of the grader. The leading insert comprises a material that has an acceptable level of impact wear resistance and fracture wear resistance to function in a satisfactory fashion. The trailing insert experiences contact with the surface of the substrate, as well as the transfer of the down-pressure force on the grader blade. The trailing insert comprises a material that has an acceptable level of abrasion wear resistance and down-pressure wear resistance to function in satisfactory fashion. The mediate insert has wear resistance properties between those of the leading insert and the trailing insert. The presence of the mediate insert provides the leading insert with additional support as compared to an insert assembly with only the leading and trailing inserts. The mediate insert provides the additional support to maintain the integrity of the insert assembly during operation. The mediate insert also provides to the entire tri-grade insert assembly additional abrasion wear resistance and down-pressure wear resistance.

It is apparent that the present grader blade provides an improved grade blade structure. The present grader blade more adequately addresses the kinds of wear and forces encountered by the bottom leading edge of the grader blade. The present grader blade provides an improved grader blade that provides improved impact wear resistance. The present grader blade also provides an improved grader blade that provides improved fracture wear resistance. The present grader blade further provides an improved grader blade that provides improved abrasion wear resistance. The present grader blade provides an improved grader blade that provides improved down-pressure wear resistance.

The patents and other documents identified herein are hereby incorporated by reference herein. Other embodiments of the invention will be apparent to those skilled in the art from a consideration of the specification or a practice of the invention disclosed herein. It is intended that the specification and examples are illustrative only and are not intended to be limiting on the scope of the invention. The true scope and spirit of the invention is indicated by the following claims.

What is claimed is:

1. A grader blade comprising:

a grader blade body having a recess contained in a bottom edge;

a tri-grade insert assembly received within the recess, and the tri-grade insert assembly comprising a leading insert, a mediate insert and a trailing insert; and wherein the leading insert having an impact wear resistance and fracture wear resistance greater than the mediate insert and the trailing insert, the trailing insert having an abrasion wear resistance and down-pressure wear resistance greater than the leading insert and the mediate insert, and the mediate insert having an impact wear resistance and fracture wear resistance greater than the trailing insert and an abrasion wear resistance and down-pressure wear resistance greater than the leading insert and wherein the leading insert, the mediate insert and the trailing insert each comprise cemented (cobalt) tungsten carbide, and the leading insert has a higher cobalt content than the mediate insert and the trailing insert, and the mediate insert has a higher cobalt content than the trailing insert; and wherein the leading insert having a height greater than the height of the mediate insert and the trailing insert, and the mediate insert having a height greater than the height of the trailing insert.

2. The grader blade according to claim 1 wherein the leading insert comprises between about 18 weight percent and about 22 weight percent cobalt and between about 78 weight percent and about 82 weight percent tungsten carbide, the mediate insert comprises between about 14 weight percent and about 16 weight percent cobalt and between about 84 weight percent and about 86 weight percent tungsten carbide, the trailing insert comprises between about 11 weight percent and about 13 weight percent cobalt and between about 87 weight percent and about 89 weight percent tungsten carbide.

3. The grader blade according to claim 1 wherein the leading insert comprises between about 19.5 weight percent and about 20.5 weight percent cobalt and between about 79.5 weight percent and about 80.5 weight percent tungsten carbide, the mediate insert comprises between about 14 weight percent and about 16 weight percent cobalt and between about 84 weight percent and about 86 weight percent tungsten carbide, the trailing insert comprises between about 11 weight percent and about 12.4 weight percent cobalt and between about 87.6 weight percent and about 89 weight percent tungsten carbide.

4. The grader blade according to claim 1 the leading insert, mediate insert and trailing insert are joined together to form the tri-grade insert assembly.

5. The grader blade according to claim 1 wherein the grader blade body comprising one of the materials selected from the group consisting of cast ferrous materials, wrought ferrous materials, urethane materials, polyurethane materials, rubber materials and plastic materials.

6. The grader blade according to claim 1 wherein the leading insert, the trailing insert and the mediate insert are made from the same kind of material with each one of the inserts having a different composition.

7. The grader blade according to claim 1 wherein the leading insert, the trailing insert and the mediate insert are made from different kinds of materials.

8. The grader blade according to claim 1 wherein the recess comprises a pair of planar intersecting surfaces.

9. The grader blade according to claim 1 wherein the grader blade body has a leading surface, and the recess opens to the leading surface.

10. The grader blade according to claim 1 wherein the grader blade body has a leading surface and a trailing surface, and the recess is mediate of the leading surface and the trailing surface.

11. A grader blade comprising:

a grader blade body having a recess contained in a bottom edge;

a tri-grade insert assembly received within the recess, and the tri-grade insert assembly comprising a leading insert, a mediate insert and a trailing insert; and wherein the leading insert having an impact wear resistance and fracture wear resistance greater than the mediate insert and the trailing insert, the trailing insert having an abrasion wear resistance and down-pressure wear resistance greater than the leading insert and the mediate insert, and the mediate insert having an impact wear resistance and fracture wear resistance greater than the trailing insert and an abrasion wear resistance and down-pressure wear resistance greater than the leading insert and wherein the leading insert, the mediate insert and the trailing insert each comprise cemented (cobalt) tungsten carbide, and the leading insert has a higher cobalt content than the mediate insert and the trailing insert, and the mediate insert has a higher cobalt content than the trailing insert; and wherein the grader blade body has a trailing surface, and the recess opens to the trailing surface.

12. A grader blade comprising:

a grader blade body having a recess contained in a bottom edge;

a tri-grade insert assembly received within the recess, and the tri-grade insert assembly comprising a leading insert, a mediate insert and a trailing insert; and wherein the leading insert having an impact wear resistance and fracture wear resistance greater than the mediate insert and the trailing insert, the trailing insert having an abrasion wear resistance and down-pressure wear resistance greater than the leading insert and the mediate insert, and the mediate insert having an impact wear resistance and fracture wear resistance greater than the trailing insert and an abrasion wear resistance and down-pressure wear resistance greater than the leading insert and wherein the leading insert, the mediate insert and the trailing insert each comprise cemented (cobalt) tungsten carbide, and the leading insert has a higher cobalt content than the mediate insert and the trailing insert, and the mediate insert has a higher cobalt content than the trailing insert; and wherein the grader blade body has a leading surface and a trailing surface; the recess presents a leading step that receives the leading insert, a mediate step that receives the mediate insert, and a trailing step that receives the trailing insert; and the leading step, mediate step and trailing step become deeper in the direction of the trailing surface.

13. A grader blade comprising:

a grader blade body having a recess contained in a bottom edge;

a tri-grade insert assembly received within the recess, and the tri-grade insert assembly comprising a leading insert, a mediate insert and a trailing insert; and wherein the leading insert having an impact wear resistance and fracture wear resistance greater than the mediate insert and the trailing insert, the trailing insert having an abrasion wear resistance and down-pressure wear resistance greater than the leading insert and the mediate insert, and the mediate insert having an impact wear resistance and fracture wear resistance greater than the trailing insert and an abrasion wear resistance and down-pressure wear resistance greater than the leading insert and wherein the leading insert, the mediate insert and the trailing insert each comprise cemented (cobalt) tungsten carbide, and the leading insert has a higher cobalt content than the mediate insert and the trailing insert, and the mediate insert has a higher cobalt content than the trailing insert; and wherein the grader blade body has a leading surface and a trailing surface; the recess presents a leading step that receives the leading insert, a mediate step that receives the mediate insert, and a trailing step that receives the trailing insert; and the leading step, mediate step and trailing step become deeper in the direction of the leading surface.

14. A grader blade comprising:

a grader blade body having a recess contained in a bottom edge;

a tri-grade insert assembly received within the recess, and the tri-grade insert assembly comprising a leading insert, a mediate insert and a trailing insert; and wherein the leading insert having an impact wear resistance and fracture wear resistance greater than the mediate insert and the trailing insert, the trailing insert having an abrasion wear resistance and down-pressure wear resistance greater than the leading insert and the mediate insert, and the mediate insert having an impact wear resistance and fracture wear resistance greater than the trailing insert and an abrasion wear resistance and down-pressure wear resistance greater than the leading insert and wherein the leading insert, the mediate insert and the trailing insert each comprise cemented (cobalt) tungsten carbide, and the leading insert has a higher cobalt content than the mediate insert and the trailing insert, and the mediate insert has a higher cobalt content than the trailing insert; and wherein the grader blade body has a leading surface and a trailing surface; the recess presents a leading step that receives the leading insert, a mediate step that receives the mediate insert, and a trailing step that receives the trailing insert; and the mediate step having a depth greater than the depth of the leading step and the trailing step.

15. A grader blade comprising:

a grader blade body having a recess contained in a bottom edge;

a tri-grade insert assembly received within the recess, and the tri-grade insert assembly comprising a leading insert, a mediate insert and a trailing insert; and wherein the leading insert having an impact wear resistance and fracture wear resistance greater than the mediate insert and the trailing insert, the trailing insert having an abrasion wear resistance and down-pressure wear resistance greater than the leading insert and the mediate insert, and the mediate insert having an impact wear resistance and fracture wear resistance greater than the trailing insert and an abrasion wear resistance and down-pressure wear resistance greater than the leading insert and wherein the leading insert, the mediate insert and the trailing insert each comprise cemented (cobalt) tungsten carbide, and the leading insert has a higher cobalt content than the mediate insert and the trailing insert, and the mediate insert has a higher cobalt content than the trailing insert; and further comprising a spacer between the mediate insert and one or more of the leading insert and the trailing insert; and the spacer comprising urethane materials, polyurethane materials, rubber materials and plastic materials.

16. A grader blade comprising:

a grader blade body having a recess contained in a bottom edge;

a tri-grade insert assembly received within the recess, and the tri-grade insert assembly comprising a leading insert, a mediate insert and a trailing insert; and wherein the leading insert having an impact wear resistance and fracture wear resistance greater than the mediate insert and the trailing insert, the trailing insert having an abrasion wear resistance and down-pressure wear resistance greater than the leading insert and the mediate insert, and the mediate insert having an impact wear resistance and fracture wear resistance greater than the trailing insert and an abrasion wear resistance and down-pressure wear resistance greater than the leading insert and wherein the leading insert, the mediate insert and the trailing insert each comprise cemented (cobalt) tungsten carbide, and the leading insert has a higher cobalt content than the mediate insert and the trailing insert, and the mediate insert has a higher cobalt content than the trailing insert; and further comprising one spacer between the mediate insert and the leading insert, and another spacer between the mediate insert and the trailing insert; and the one spacer and other spacer comprising one of the following materials; urethane materials, polyurethane materials, rubber materials and plastic materials.

17. A grader blade comprising:

a grader blade body having a recess contained in a bottom edge;

an insert assembly received within the recess, and the insert assembly comprising a leading insert, a mediate insert and a trailing insert;

wherein the leading insert comprising one of the following materials: cemented carbides, ceramics, cermets, chromium-carbide-coated metals, cermets where titanium carbide or vanadium carbide is added to tungsten carbide, aluminum-based ceramics, silicon-based ceramics, zirconium-based ceramics, glass-based ceramics, and superhard materials, and the leading insert having an impact wear resistance and fracture wear resistance greater than the trailing insert;

the trailing insert comprising one of the following materials: cemented carbides, ceramics, cermets, chromium-carbide-coated metals, cermets where titanium carbide or vanadium carbide is added to tungsten carbide, aluminum-based ceramics, silicon-based ceramics, zirconium-based ceramics, glass-based ceramics, and superhard materials, and the trailing insert having an abrasion wear resistance and down-pressure wear resistance greater than the leading insert; and the mediate insert comprising one of the following materials: urethane materials, polyurethane materials, rubber materials and plastic materials.

* * * * *